US008180076B2

(12) United States Patent
Bastyr et al.

(10) Patent No.: US 8,180,076 B2
(45) Date of Patent: May 15, 2012

(54) SYSTEM AND METHOD FOR REDUCING BAFFLE VIBRATION

(75) Inventors: Kevin J. Bastyr, Somerville, MA (US); Michael W. Stark, Acton, MA (US)

(73) Assignee: Bose Corporation, Framingham, MA (US)

( * ) Notice: Subject to any disclaimer, the term of this patent is extended or adjusted under 35 U.S.C. 154(b) by 919 days.

(21) Appl. No.: 12/183,325

(22) Filed: Jul. 31, 2008

(65) Prior Publication Data

US 2010/0027816 A1 Feb. 4, 2010

(51) Int. Cl.
*H04R 1/24* (2006.01)

(52) U.S. Cl. ..... 381/182; 381/71.2

(58) Field of Classification Search ..... 381/71.2, 381/162, 182, 186, 400, 401; 181/163, 171, 181/172, 173

See application file for complete search history.

(56) References Cited

U.S. PATENT DOCUMENTS

| | | | |
|---|---|---|---|
| 2,358,823 | A | 9/1944 | O'Connor et al. |
| 2,768,702 | A | 10/1956 | Lowry |
| 2,993,091 | A | 7/1961 | Guss |
| 3,202,773 | A | 8/1965 | Tichy |
| 3,649,776 | A | 3/1972 | Burton |
| 3,688,864 | A | 9/1972 | Reuben Guss |
| 3,815,707 | A | 6/1974 | Burhoe |
| 4,008,374 | A | 2/1977 | Tiefenbrun |
| 4,039,044 | A | 8/1977 | Heil |
| 4,182,931 | A | 1/1980 | Kenner |
| 4,213,008 | A | 7/1980 | Helffrich |
| 4,325,454 | A | 4/1982 | Humphrey |
| 4,504,704 | A | 3/1985 | Ohyaba et al. |
| 4,590,333 | A | 5/1986 | Strohbeen |
| 4,733,749 | A | 3/1988 | Newman et al. |
| 4,783,820 | A | 11/1988 | Lyngdorf et al. |
| 4,875,546 | A | 10/1989 | Krnan |
| 4,882,760 | A | 11/1989 | Yee |
| 4,903,300 | A | 2/1990 | Polk |
| 5,023,914 | A | 6/1991 | Arnold |
| 5,092,424 | A | 3/1992 | Schreiber et al. |
| 5,119,431 | A | 6/1992 | Hamby |
| 5,212,732 | A | 5/1993 | Hipps et al. |
| 5,253,301 | A | 10/1993 | Sakamoto et al. |
| 5,388,162 | A | 2/1995 | Sohn |
| 5,532,437 | A | 7/1996 | Simplicean et al. |
| 5,537,479 | A | 7/1996 | Kreisel et al. |
| 5,594,804 | A | 1/1997 | Kim |

(Continued)

FOREIGN PATENT DOCUMENTS

| | | |
|---|---|---|
| DE | 40 19 645 | 1/1991 |

(Continued)

OTHER PUBLICATIONS

International Search Report and Written Opinion for PCT/US2009/047959 dated Sep. 23, 2009.

(Continued)

*Primary Examiner* — Tom Thomas
*Assistant Examiner* — Christopher M Roland
(74) *Attorney, Agent, or Firm* — Bose Corporation

(57) ABSTRACT

Adjustments to an electro-acoustic transducer may be made to match the performance of a second electro-acoustic transducer such that a net inertial force generated by movement of the electro-acoustic transducers' diaphragms are substantially zero. Adjustments may include adjusting a moving mass of one of the elector-acoustic transducers. Adjustments may include applying an equalization to one of the electro-acoustic transducers.

9 Claims, 4 Drawing Sheets

U.S. PATENT DOCUMENTS

| | | | | |
|---|---|---|---|---|
| 5,621,804 | A | 4/1997 | Beppu | |
| 5,664,020 | A | 9/1997 | Goldfarb et al. | |
| 5,703,337 | A | 12/1997 | Geisenberger | |
| 5,850,460 | A | 12/1998 | Tanaka et al. | |
| 6,031,919 | A | 2/2000 | Funahashi et al. | |
| 6,031,925 | A | 2/2000 | Shteyn | |
| 6,195,442 | B1 | 2/2001 | Griffin et al. | |
| 6,353,670 | B1 | 3/2002 | Gasner | |
| 6,493,452 | B1 | 12/2002 | Koizumi et al. | |
| 6,628,792 | B1 | 9/2003 | Paddock | |
| 6,678,384 | B2 | 1/2004 | Kowaki et al. | |
| 6,878,384 | B2 | 4/2005 | Cruise et al. | |
| 6,985,593 | B2 | 1/2006 | Nichols et al. | |
| 7,983,436 | B2 | 7/2011 | Nichols et al. | |
| 2002/0150275 | A1 | 10/2002 | Guenther | |
| 2004/0008858 | A1 | 1/2004 | Steere et al. | |
| 2004/0008859 | A1 | 1/2004 | Zhao | |
| 2004/0017920 | A1 | 1/2004 | Nishikawa et al. | |
| 2004/0105565 | A1 | 6/2004 | Butters et al. | |
| 2004/0208338 | A1 | 10/2004 | Pan et al. | |
| 2005/0018868 | A1* | 1/2005 | Chick et al. | 381/349 |
| 2005/0111673 | A1 | 5/2005 | Rosen et al. | |
| 2005/0129258 | A1 | 6/2005 | Fincham | |
| 2008/0101646 | A1 | 5/2008 | Holmi | |
| 2012/0008813 | A1* | 1/2012 | Rosen | 381/353 |

FOREIGN PATENT DOCUMENTS

| | | | |
|---|---|---|---|
| DE | 19637847 | | 3/1998 |
| EP | 0410352 | | 1/1991 |
| EP | 0771133 | | 5/1997 |
| EP | 0917396 | A2 | 5/1999 |
| EP | 1257147 | | 11/2002 |
| EP | 1427247 | | 6/2004 |
| EP | 1679936 | A2 | 7/2006 |
| GB | 2258355 | | 2/1993 |
| GB | 2258365 | | 2/1993 |
| GB | 2387987 | | 10/2003 |
| JP | 54023519 | | 2/1979 |
| JP | 07170597 | | 7/1995 |
| JP | 8019089 | | 1/1996 |
| JP | 10178693 | | 6/1998 |
| JP | 11027784 | | 1/1999 |
| JP | 11178085 | | 7/1999 |
| WO | 9967975 | | 12/1999 |
| WO | 02052892 | | 7/2002 |

OTHER PUBLICATIONS

International Search Report on Patentability dated Feb. 10, 2011, 7 pages for PCT/US2009/047959.

Office Action dated Jun. 6, 2008 from China Application No. 03147033.5.

EP Search Report, dated Apr. 18, 2008 for EP Application No. 05111421.3.

CN Office Action dated Nov. 11, 2010 for CN Appl. No. 200510003464.9.

D.B. Keele, Jr, KEF Reference Series Model Four Speakers, Audio/ Jun. 1996, pp. 50-55.

EP Examination Report for EP Appln. No. 03102533.1, dated Oct. 30, 2009.

http://www.linkwitzlab.com/woofer.htm, (Aug. 11, 2003).

CN Office Action dated Jun. 12, 2009 for CN Application No. 03147033.5.

* cited by examiner

SYSTEM AND METHOD FOR REDUCING BAFFLE VIBRATION

BACKGROUND

This disclosure relates to loudspeaker audio systems having reduced vibration.

A moving diaphragm in an electro-acoustic transducer generates an inertial reaction force on a basket supporting the diaphragm that is transmitted to an enclosure or baffle that partitions a volume into a listening volume and a back volume. The baffle is typically stiff in the plane of the baffle but is susceptible to vibrations perpendicular to the baffle plane. An inertial reaction force having a component perpendicular to the baffle plane can generate a buzzing or an audible noise that detracts from the acoustic signal generated by the electro-acoustic transducer. Although baffle vibration can be problematic at any frequency, baffle vibration may be significant for electro-acoustic transducers generating acoustic signals in a frequency range of less than about 150 Hz, which are commonly referred to as bass speakers or woofers.

U.S. Pat. No. 6,985,593 issued Jan. 10, 2006, U.S. Publication No. US2005/0111673 published May 26, 2005, now U.S. Pat. No. 7,551,749, and U.S. Publication No. US2008/0101646 published May 1, 2008, now U.S. Pat. No. 7,983,436, describe methods and systems for reducing baffle vibrations and are incorporated herein by reference in their entirety. In the described methods and systems, two or more diaphragms are oriented relative to each other such that the net reaction force generated by the two or more diaphragms is preferably zero or less than the reaction force generated by a single diaphragm.

SUMMARY

Adjustments to an electro-acoustic transducer may be made to match the performance of a second electro-acoustic transducer such that a net inertial force generated by movement of the electro-acoustic transducers' diaphragms are substantially zero. Adjustments may include adjusting a moving mass of one of the electro-acoustic transducers. Adjustments may include applying an equalization to one of the electro-acoustic transducers.

One embodiment of the present invention is directed to a system comprising: a first electro-acoustic transducer; a second electro-acoustic transducer; a housing attached to a baffle, the housing supporting the first and second electro-acoustic transducers in an asymmetric configuration; and an equalizer receiving an input signal and generating an equalized signal transmitted to the second electro-acoustic transducer, wherein a net mechanical force generated by the first electro-acoustic transducer in response to the input signal and by the second electro-acoustic transducer in response to the equalized signal acting on the baffle is substantially zero. In an aspect, the asymmetric configuration includes acoustically coupling a first duct to the first electro-acoustic transducer. In an aspect, the asymmetric configuration includes acoustic coupling of a second duct to the second electro-acoustic transducer, the first and second ducts characterized by different geometries. In an aspect, the first electro-acoustic transducer is of a same type as the second electro-acoustic transducer. In an aspect, the first and second electro-acoustic transducers are woofers. In an aspect, the first electro-acoustic transducer is acoustically coupled to the second electro-acoustic transducer through a coupling volume. In an aspect, the equalizer applies an equalization curve to the input signal, the equalization curve based on the asymmetric configuration.

Another embodiment of the present invention is directed to a system comprising: a housing attached to a baffle, the housing supporting a plurality of electro-acoustic transducers of the same type in an asymmetric configuration; and a predetermined mass attached to at least one of the plurality of electro-acoustic transducers, the mass selected to reduce a net mechanical force generated by the plurality of electro-acoustic transducers acting on the baffle by at least one order of magnitude relative to an inertial force generated by a single electro-acoustic transducer of the same type. In an aspect, the predetermined mass is selected to reduce the net mechanical force by at least two orders of magnitude relative to the inertial force generated by a single electro-acoustic transducer of the same type. In an aspect, at least two of the plurality of electro-acoustic transducers are acoustically coupled through a coupling volume. In an aspect, the plurality of electro-acoustic transducers are woofers. In an aspect, the asymmetric configuration includes a duct coupling one of the plurality of electro-acoustic transducers.

Another embodiment of the present invention is directed to a method of reducing baffle vibration in a housing supporting a first and a second electro-acoustic transducer of the same type in an asymmetric configuration, the method comprising adjusting the second electro-acoustic transducer such that a net mechanical force generated by the first and second electro-acoustic transducers is substantially zero. In an aspect, the step of adjusting includes equalizing an input signal to the second electro-acoustic transducer according to a predetermined equalization curves. In an aspect, the predetermined equalization curve is based on the asymmetric configuration. In an aspect, the step of adjusting includes attaching a predetermined mass to a moving element of the first electro-acoustic transducer. In an aspect, the predetermined mass is based on the asymmetric configuration.

DETAILED DESCRIPTION

Figure 1:
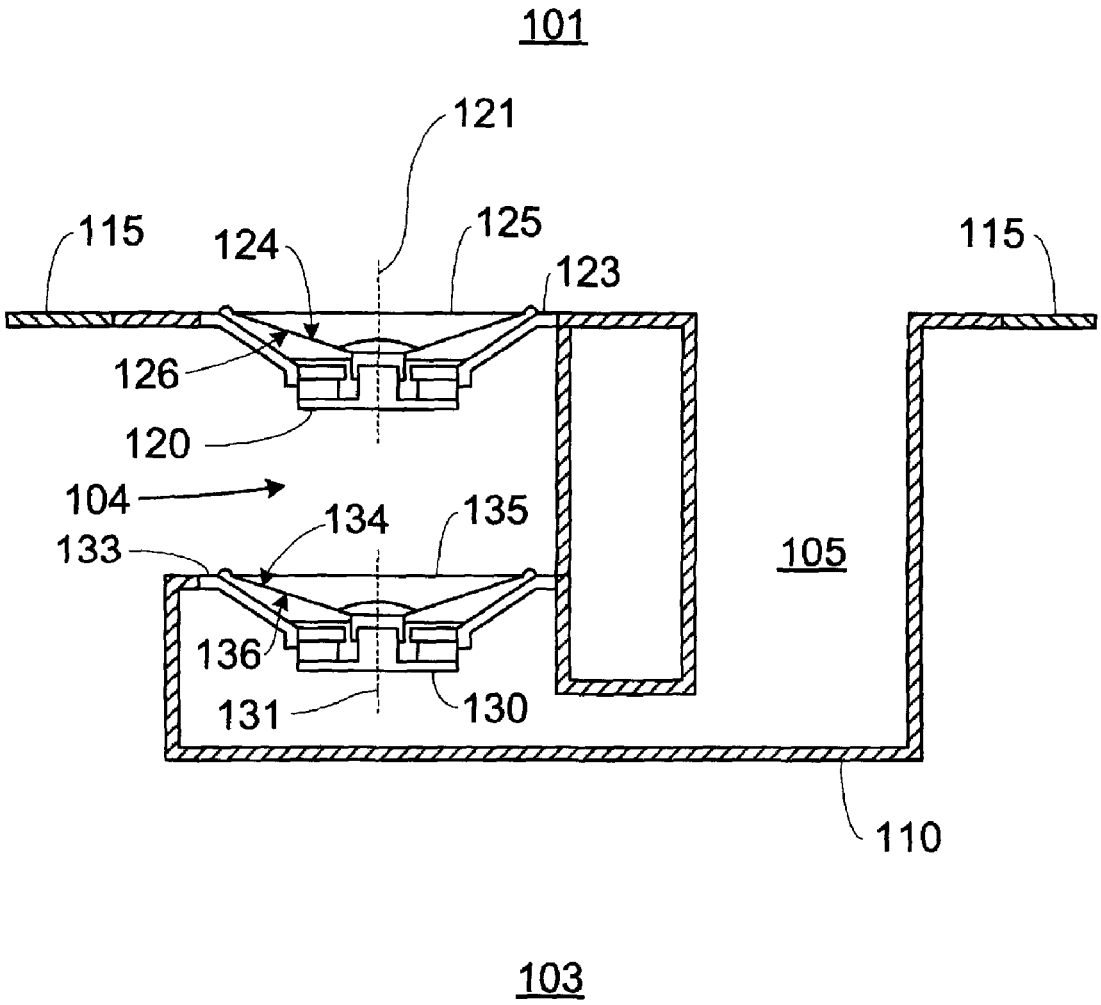
FIG. 1 is a side sectional view illustrating an asymmetric electro-acoustic configuration.

In FIG. 1, a front electro-acoustic transducer 120 and a back electro-acoustic transducer 130 are supported by housing 110. The front electro-acoustic transducer 120 is typically of the same type as the back electro-acoustic transducer 130 although different types of electro-acoustic transducers may be used. As used herein, transducers are of the same type when the transducers have similar properties. Examples of transducer properties include but are not limited to the transducer's moving mass, suspension compliance, voice coil resistance and inductance, magnetic strength, etc. Exact matching of each property is not required to be considered of the same type. For example, the typical manufacturing variations of a production run from the same or different manufacturers may produce transducers with varying properties but the slight variations are expected to be a small fraction, less than about 20% for example, of the property value such that the transducers have substantially the same performance characteristics. In some embodiments, the electro-acoustic transducers may physically appear to be of different types but may be adjusted according to the teachings herein. For example, a 6"×9" oval electro-acoustic transducer may be used with an 8" or 9" round electro-acoustic transducer when there is sufficient overlap of the acoustic energy spectrums of the 6"×9" oval and 8" or 9" round electro-acoustic transducers. In contrast, a 12" round and a 2" round electro-acoustic transducer typically have sufficiently different properties such that the acoustic energy spectrums of the transducers do not overlap sufficiently enough to allow significant inertial force balancing.

The housing 110 is attached to an enclosure or baffle 115 and together they partition a listening volume 101 from a back volume 103. The baffle 115 may be an interior surface of a vehicle or a room. Examples include but are not limited to a vehicle instrument panel, a vehicle rear package shelf, a vehicle door trim panel, a vehicle inner door skin, a trim panel in a rear cargo area of a wagon or SUV, a room wall, room floor, or a room ceiling.

Each electro-acoustic transducer 120, 130 has a diaphragm 125, 135 supported by a suspension system that typically includes a surround and spider. The suspension system preferably constrains the movement of the diaphragm 125, 135 relative to a basket 123, 133 along an axis 121, 131. Each diaphragm 125, 135 has a front side 124, 134 and a back side 126, 136. In the configuration shown in FIG. 1, the front side 124 of the front electro-acoustic transducer 120 is acoustically coupled directly to the listening volume 101 and the back side 126 of the front electro-acoustic transducer 120 is acoustically coupled to the back volume 103. The front side 134 of the back electro-acoustic transducer 130 is acoustically coupled to the back volume 103 and the back side 136 of the back electro-acoustic transducer 130 is acoustically coupled to the listening volume 101 through duct 105.

In the configuration shown in FIG. 1, the back electro-acoustic transducer 130 is driven relative to the front electro-acoustic transducer 120 such that the front diaphragm 125 and the back diaphragm 135 move into and out of the back volume 103 in unison. For example, as the front diaphragm 125 moves into the listening volume 101, the back diaphragm 135 moves into duct 105. The duct 105 is coupled to the listening volume 101 and the acoustic signal generated by the movement of the back diaphragm 135 into the duct 105 reenforces the acoustic signal generated by the movement of the front diaphragm 125 into the listening volume.

As the diaphragms 125, 135 move into and out of the back volume 103, an inertial reaction force is generated in a direction opposite to the direction of each diaphragm's movement. For the same type of electro-acoustic transducers, the inertial force generated by the front diaphragm 125 is expected to have the same magnitude but with opposite phase as the inertial force generated by the back diaphragm 135 such that a vector sum of the front inertial force and the back inertial force is substantially zero thereby reducing vibration of the baffle or enclosure. It should be understood that exact balancing of the inertial forces is unlikely in any macroscopic system and the term "substantially zero" should be understood to mean that the net resultant force of the inertial forces is at least one order of magnitude (10%), and preferably at least two orders of magnitude (1%), less than the inertial force generated by a single electro-acoustic transducer of the same type.

Simply driving the back electro-acoustic transducer 130 with a signal that is a negative (multiplied by −1) of the signal driving the front electro-acoustic transducer 120 does not, however, reduce baffle vibration as much as expected. Without being limiting, it is believed that the air in duct 105 coupled to the back side 136 of the back diaphragm 135 adds to the effective total moving mass of the back diaphragm 135 such that the front diaphragm 125 and back diaphragm 135 respond differently to the applied signal. The addition of the duct coupling the back electro-acoustic transducer adds an asymmetry to the electro-acoustic transducer configuration such that the two electro-acoustic transducers respond differently in the asymmetric configuration even though each electro-acoustic transducer responds substantially the same when measured individually.

As used herein, an asymmetric configuration includes any configuration of two or more electro-acoustic transducers of the same type where at least one of the electro-acoustic transducers experience an acoustic environment that is different from an acoustic environment experienced by the other electro-acoustic transducer. The different acoustic environment causes the electro-acoustic transducer to respond differently to the same input signal such that vector sum of inertial forces generated by the electro-acoustic transducers are not substantially zero. The acoustic environment may be affected by the volumes and structures near the electro-acoustic transducer. It should be understood that FIG. 1 shows an example of an asymmetric configuration but is not limited to the configuration shown in FIG. 1. For example, in another asymmetric configuration each electro-acoustic transducer may be coupled to the listening volume through individual ducts where each duct is characterized by a different geometry. In contrast, U.S. application Ser. No. 12/101,187 filed Apr. 11, 2008, now U.S. Pat. No. 8,031,897, herein incorporated by reference in its entirety, shows examples of symmetric configurations.

Figure 2:
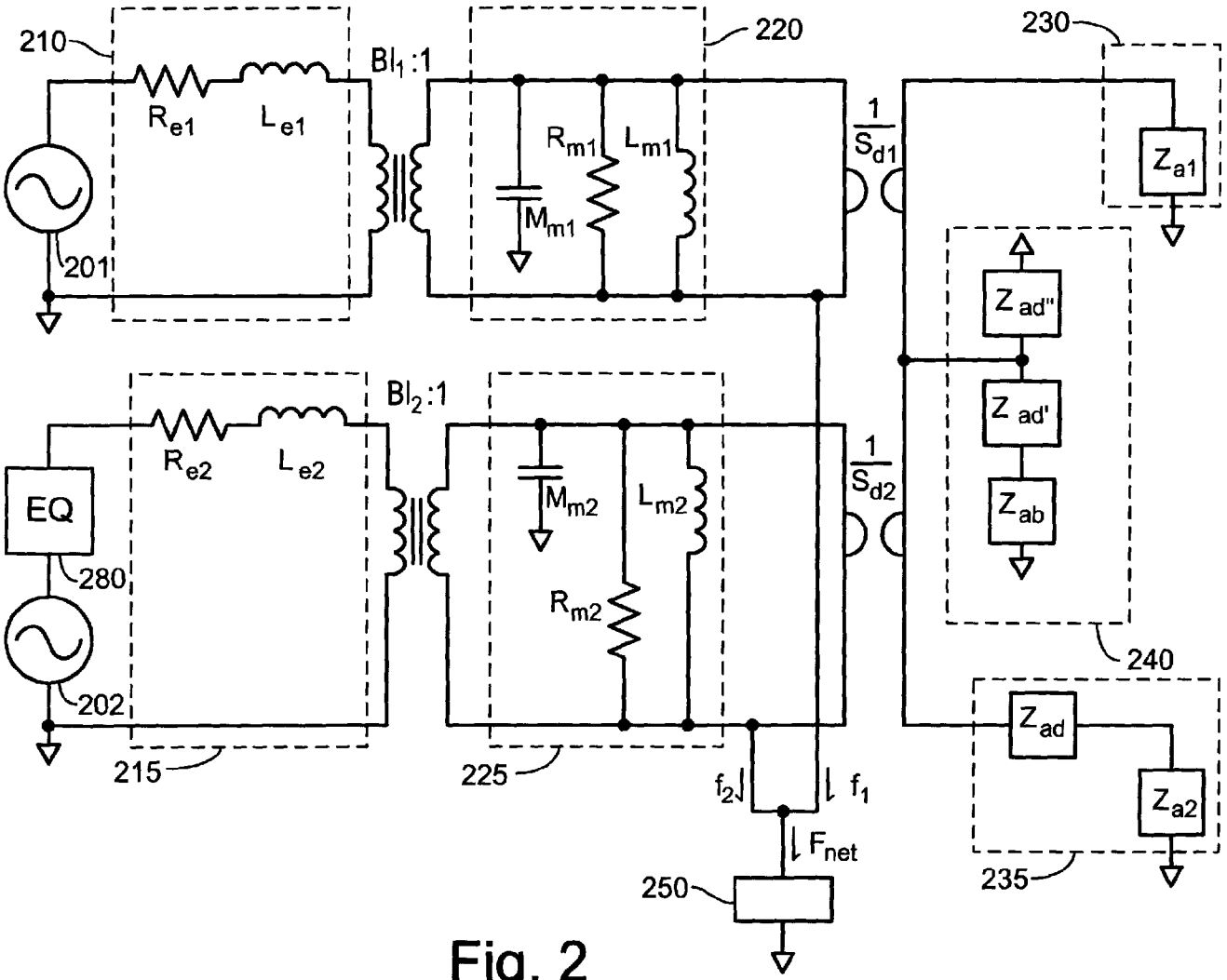
FIG. 2 illustrates an electrical equivalent-lumped-parameter model of the configuration shown in FIG. 1.

FIG. 2 is an electrical equivalent lumped parameter model of the configuration shown in FIG. 1. In FIG. 2, the configuration shown in FIG. 1 is modeled as a lumped parameter system that may be analyzed using standard electrical circuit techniques or electrical circuit analysis software packages such as, for example, the PSpice modeling software available from Cadence Design Systems, Inc. of San Jose, Calif. An input signal 201, 202 drives a voice coil 210, 215 of electro-acoustic transducers 120, 130. In the configuration shown in FIG. 1, input signal 202 is preferably the negative of input signal 201. In other configurations such as, for example, where the first and second electro-acoustic transducers are in a face-to-face or back-to-back configuration, input signal 201 may be identical to input signal 202. In the example shown in FIG. 2, an equalizer 280 provides an equalized input signal to the second electro-acoustic transducer. In other embodiments, each electro-acoustic transducer may have its own equalizer applying a different equalization curve to the input signal of each electro-acoustic transducer. The equalizer may be implemented using analog or digital circuitry known in the signal processing arts. The equalization applied to one or both of the electro-acoustic transducers compensate for the asymmetric configuration such that a net force generated by the electro-acoustic transducers on the enclosure or baffle is substantially zero.

The voice coils may be modeled 210, 215 as an electrical resistance, $R_{e1}$, $R_{e2}$, in series with an electrical inductor, $L_{e1}$, $L_{e2}$. In FIG. 2, the subscripts of each component are of the form, X#, where X represents a electrical, mechanical, or acoustic aspect of the model and are denoted by "e", "m", or "a", respectively. The number, #, in the subscript denotes the electro-acoustic transducer. Transformers having turns ratios of $BI_1$:1 and $BI_2$:1 convert from the electrical impedance domain to the mechanical mobility domain where BI represents a force to current ratio of the electro-acoustic transducer. If the electro-acoustic transducers are of the same type, $BI_1 \approx BI_2$. The mechanical aspect 220, 225 of the electro-acoustic transducer is modeled with a capacitor representing a mechanical mass, $M_{m1}$ and $M_{m2}$, a resistor representing a mechanical loss, $R_{m1}$ and $R_{m2}$, and an inductor representing a mechanical compliance, $L_{m1}$ and $L_{m2}$. If the electro-acoustic transducers are of the same type, $M_{m1} \approx M_{m2}$, $R_{m1} \approx R_{m2}$, and $L_{m1} \approx L_{m2}$. Electrical gyrators having values of $1/S_{d1}$ and $1/S_{d2}$ convert from the mechanical mobility domain to the acoustical impedance domain where $S_{d1}$ represents a surface area of the first electro-acoustic transducer and $S_{d2}$ represents a surface area of the second electro-acoustic transducer. If the electro-acoustic transducers are of the same type, $S_{d1} \approx S_{d2}$.

The acoustic aspect 230 of the first electro-acoustic transducer includes an acoustic impedance, $Z_{a1}$, that models an acoustic radiation from the first electro-acoustic transducer. The acoustic aspect 235 of the second electro-acoustic transducer includes an acoustic impedance, $Z_{a2}$, that models an acoustic radiation from the second electro-acoustic transducer and an acoustic impedance, $Z_{ad}$, that models the duct 105 coupling the back side 136 of diaphragm 135 to listening volume 101. A coupling volume 104 between the first and second electro-acoustic transducers couples the acoustic behavior of the electro-acoustic transducers. The acoustic aspect 240 of the coupling volume is modeled using an acoustic impedance, $Z_{ab}$, representing an acoustic radiation to the back volume 103, and acoustic impedances, $Z_{ad''}$ and $Z_{ad'}$, representing portions of the coupling volume.

The mechanical forces generated by the electro-acoustic transducers, $f_1$ and $f_2$, acting on the baffle 115 are vector summed to provide a net mechanical force, $F_{net}$, acting on the baffle represented by impedance 250.

The duct 105 coupling the back side of the back diaphragm 136 creates an asymmetric configuration such that even if the front and back electro-acoustic transducers are of the same type, the reaction force created by the motion of the diaphragms do not balance each other resulting in a net mechanical force, $F_{net}$, applied to the baffle and generation of unwanted vibrations of the baffle. The configuration shown in FIG. 1 is but one example of an asymmetric configuration that can result in a net force on the baffle. For example, both electro-acoustic transducers may be coupled to the listening volume through individual ducts of different geometries. The differently shaped ducts may induce sufficient asymmetry into the configuration that results in a non-zero net force applied to the baffle.

Figure 3:
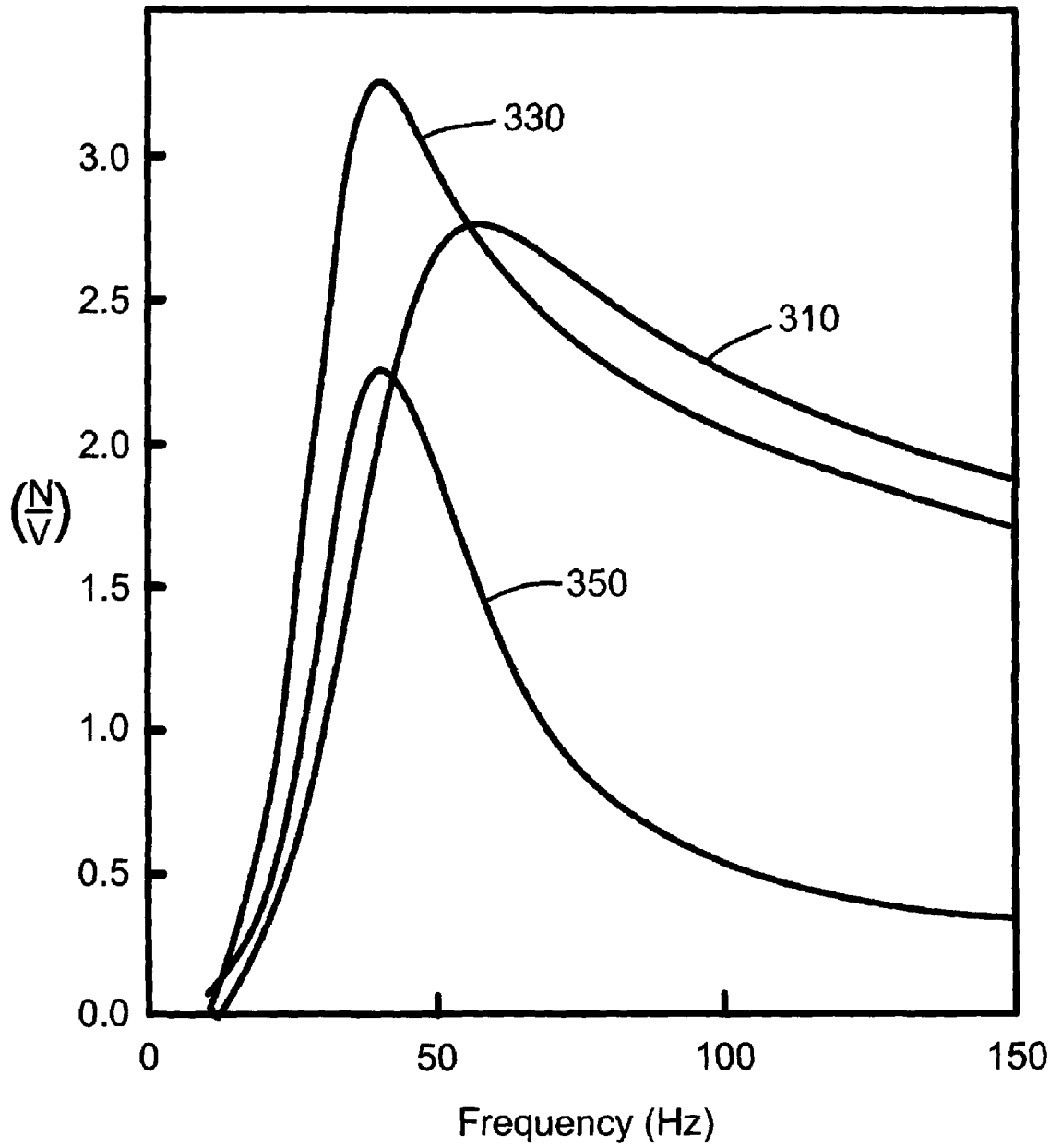
FIG. 3 displays reaction forces and a net force generated in the asymmetric configuration shown in FIG. 1.

FIG. 3 illustrates the reaction forces from each electro-acoustic transducer and the net reaction force applied to the baffle calculated using the model shown in FIG. 2. In FIG. 3, reaction forces, in Newtons/Volt, are shown as a function of frequency for the front electro-acoustic transducer 310, the back electro-acoustic transducer 330, and the net reaction force 350. As FIG. 3 indicates, even though both electro-acoustic transducers are modeled using the same parameter values, the asymmetric configuration resulting from the duct 105 coupling the back electro-acoustic transducer to the listening volume 101 affects the reaction force generated by the back electro-acoustic transducer such that the reaction forces of the electro-acoustic transducers no longer cancel each other thereby generating a non-zero net reaction force 350 on the baffle.

Figure 4:
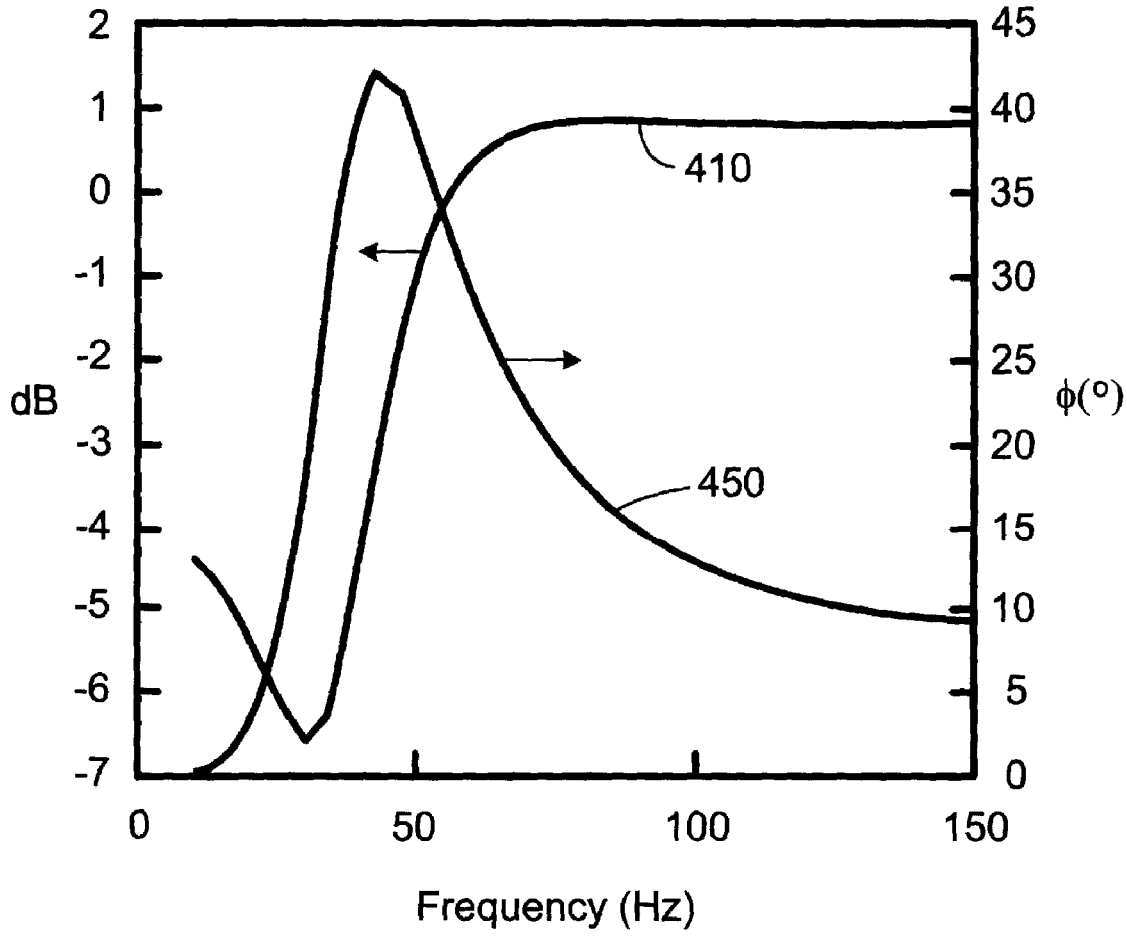
FIG. 4 displays magnitude and phase equalization curves that results in a zero net force when applied to the configuration shown in FIG. 1.

FIG. 4 illustrates equalization curves that may be applied to an input signal driving the back electro-acoustic transducer shown in FIG. 1. The equalization magnitude 410 is shown in dB and the equalization phase 450 is shown in degrees. The equalization curves shown in FIG. 4 may be generated by setting the net reaction force, $F_{net}=0$ and solving for the equalization. Equalization of the input signal may be implemented using analog or digital methods known in signal processing arts. Although the equalization curves shown in FIG. 4 are generated using simulation tools, in other embodiments, the equalization curves may be generated by individually measuring an acceleration where the housing is attached to the baffle. The equalization curves are determined based on the specific asymmetric configuration and may be different for different asymmetric configurations.

In another embodiment, the equalizer may be eliminated by adjusting the mass of one or more of the moving elements of the electro-acoustic transducers to account for the asymmetric configuration. The moving elements may include the portions of the electro-acoustic transducer that contribute to the inertial reaction force of the electro-acoustic transducer. Examples of moving elements that contribute to the inertial reaction force include the diaphragm, bobbin, voice coil, dust cover, electrical leads, and portions of the spider and surround. In the asymmetric configuration shown in FIG. 1, a mass may be added to a moving element of electro-acoustic transducer 120 or a mass may be removed from a moving element of electro-acoustic transducer 130 or any combination thereof. The mass may be a predetermined value based on the geometry of the asymmetric configuration. For example, in the configuration shown in FIG. 1, the predetermined mass may be estimated as the effective acoustic mass of the duct added to the back electro-acoustic transducer. The predetermined mass may be determined by a simulation model such as the one shown in FIG. 2 or may be determined by measuring a resonance frequency of each electro-acoustic transducer and adjusting a moving mass until the measured resonance frequencies of the electro-acoustic transducers are substantially equal. At high frequencies, for example at frequencies greater than about 150 Hz, the acoustic compliance of a duct may become significant and may not be fully compensated by the mass adjustments to one or more of the electro-acoustic transducers that may result in a non-zero net force applied to the baffle. The non-zero net force at these high frequencies, however, are expected to be much lower than the low frequency forces generated by the electro-acoustic transducers. The predetermined mass may be added to one or more of the moving elements of the electro-acoustic transducers. In other embodiments, the predetermined mass may be incorporated into one or more of the moving elements of the electro-acoustic transducers. For example, the predetermined mass may be attached to an unadjusted diaphragm of the electro-acoustic transducer or a diaphragm having a mass equal to a sum of a mass of the unadjusted diaphragm and the predetermined mass may be used in the electro-acoustic transducer. As used herein, attachment of the predetermined mass to a moving element includes attachment of the predetermined mass to the unadjusted moving element or incorporation of the predetermined mass as part of the moving element.

Embodiments of the systems and methods described above may comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the present invention.

Having thus described at least illustrative embodiments of the invention, various modifications and improvements will readily occur to those skilled in the art and are intended to be within the scope of the invention. For example, the embodiment shown in FIG. 1 illustrates only one of a variety of asymmetric configurations that may be contemplated but it should be understood that the teaching described herein may be applied to any asymmetric configuration. Furthermore, the teachings described herein may be applied to asymmetric configurations of more than two electro-acoustic transducers without undue effort by one skilled in the art. Accordingly, the foregoing description is by way of example only and is not intended as limiting. The invention is limited only as defined in the following claims and the equivalents thereto.

What is claimed:

1. A system comprising:

a first electro-acoustic transducer;

a second electro-acoustic transducer having substantially the same performance characteristics as the first electro-acoustic transducer;

a housing attached to a baffle, the housing supporting the first and second electro-acoustic transducers in an asymmetric configuration applying different acoustic loads to the first and second electro-acoustic transducers; and an equalizer receiving an input signal and generating an equalized signal based on a configuration of the housing transmitted to the second electro-acoustic transducer, wherein a net mechanical force generated by the first electro-acoustic transducer in response to the input signal and by the second electro-acoustic transducer in response to the equalized signal acting on the baffle is substantially zero.

2. The system of claim 1 wherein the asymmetric configuration includes acoustically coupling a first duct to the first electro-acoustic transducer.

3. The system of claim 1 wherein the first electro-acoustic transducer is of a same type as the second electro-acoustic transducer.

4. The system of claim 1 wherein the first and second electro-acoustic transducers are woofers.

5. The system of claim 1 wherein the first electro-acoustic transducer is acoustically coupled to the second electro-acoustic transducer through a coupling volume.

6. The system of claim 1 wherein the equalizer applies an equalization curve to the input signal, the equalization curve based on the asymmetric configuration.

7. A method of reducing baffle vibration in a housing supporting a first and a second electro-acoustic transducer of the same type in an asymmetric configuration, the method comprising:

receiving an input signal;

generating an equalized signal based on a configuration of the housing; and transmitting the equalized signal to the second electro-acoustic transducer;

wherein the equalized signal is generated such that a net mechanical force generated by the first electro-acoustic transducer in response to the input signal and by the second electro-acoustic transducer in response to the equalized signal acting on the baffle is substantially zero.

8. The method of claim 7 wherein the step of generating the equalized signal includes equalizing the input signal according to a predetermined equalization curve.

9. The method of claim 8 wherein the predetermined equalization curve is based on the asymmetric configuration.

* * * * *